United States Patent [19]

Woods

[11] 4,146,347

[45] Mar. 27, 1979

[54] METHOD AND APPARATUS FOR LATERAL EXCAVATION

[76] Inventor: Roger Woods, R.R. #3, Watford, Ontario, Canada

[21] Appl. No.: 816,962

[22] Filed: Jul. 19, 1977

[30] Foreign Application Priority Data

Jun. 13, 1977 [CA] Canada ..... 280436

[51] Int. Cl.[2] ..... F16L 1/00

[52] U.S. Cl. ..... 405/184; 175/53; 175/56; 175/62; 405/138

[58] Field of Search ..... 61/42, 72.7; 175/53, 175/56, 62; 173/49

[56] References Cited

U.S. PATENT DOCUMENTS

| | | | |
|---|---|---|---|
| 2,693,345 | 11/1954 | Martin et al. | 61/72.7 X |
| 2,752,122 | 6/1956 | Hyatt et al. | 175/62 X |
| 2,823,898 | 2/1958 | Bankston | 61/72.7 X |
| 3,283,833 | 11/1966 | Bodine | 175/56 |
| 3,339,646 | 9/1967 | Bodine | 175/62 |
| 3,881,558 | 5/1975 | Dolza | 61/72.7 X |

*Primary Examiner*—Mervin Stein
*Assistant Examiner*—David H. Corbin
*Attorney, Agent, or Firm*—Finnegan, Henderson, Farabow & Garrett

[57] ABSTRACT

The invention discloses a method and apparatus for placing, insitu, beneath roadways and the like, pipe or other longitudinal members, without the need to remove the overburden. This accomplished by vibrating the pipe into position with the use of a special frame which holds the pipe and a vibrating tool and guides the pipe into its insitu position.

3 Claims, 7 Drawing Figures

METHOD AND APPARATUS FOR LATERAL EXCAVATION

This invention relates to a method and apparatus for excavating laterally through soil.

It is common to use pile drivers for driving piles vertically in the ground. These piles then serve as a crib or support wall during excavation for foundations of large buildings. Sometimes they become part of the structure as in wharfages.

Conventional pile drivers are reciprocating hammers which hit sheet piling or the like and drive it into the ground.

More recently it has become known to apply vibration to the sheet piles by means of a vibrator. The vertical vibration is transmitted, undiminished, to the pile through a clamp head of the driving head of the vibrator. Greater efficiency and speed is achieved in driving the pile via vibration when compared to hitting. Further the vibration technique is superior when driving sheet piling into very viscous soil or quick-sand since the pile rebound, typically encountered by hitting, is eliminated.

A commercial version of such a vibrator is a Vibro-Drive/Extractor sold by L.B. Foster Company, Pittsburgh, Pennsylvania, U.S.A. These vibrators heretofore only have been used in vertical driving or extraction of sheeting, piling, pipes, cassions and the like.

I have conceived of a means and method of employing the principle of vibration to drive laterally, pipes, cassions, sheeting and the like through the ground.

With this means and method it is relatively simple to "bore" under highways, railroads and other obstacles and to place beneath them a pipe (as for oil, gas, sewerage and the like) without disruption of the travelling surface. Conventional techniques on the other hand, require removal of the road surface; then excavation of a channel to accommodate the pipe; laying the pipe; backfilling; and restoration of the roadway again.

Sometimes settling occurs and the roadway requires rebuilding.

My invention obviates this procedure and its problems.

The embodiments of my invention also have other application as in positioning rods and the like horizontally, when removal of overburden is not desired.

The invention thus achieves a method and apparatus for installing, horizontally, members by utilizing vibration motion.

The invention contemplates a method of inserting and embedding a pipe essentially laterally into and through soil without removing the overburden comprising the steps of:

(a) affixing to one end of the pipe, which is to penetrate the soil, a cable and extending the cable through the pipe to extend out the other end;

(b) engaging the penetrating end of the pipe with the soil;

(c) vibrating the pipe until the pipe has migrated into the soil a predetermined distance and the penetrating end of the pipe has passed completely through the overburden;

(d) severing the cable from the end of the pipe and affixing a clean out disc with a diameter essentially coincident with the inside diameter of the pipe to the end of the cable;

(e) withdrawing the cable from the pipe by pulling the disc from the penetrating end through the pipe to its other end by which any soil residing as core in the pipe is substantially removed.

The invention in another aspect contemplates an apparatus for penetrating a member laterally into and through soil without removal of the overburden comprising;

(a) a longitudinal member;

(b) a vibrator having a vibrating tool;

(c) an anvil means attached to the longitudinal member and engageable by the vibrating tool to impart longitudinal vibrations to said longitudinal member;

(d) a support frame for cooperatively holding the vibrator and the longitudinal member in a non-vertical position, the support frame including:

(i) a generally flat chassis having supporting connectors affixed thereto;

(ii) a U-shaped chuck with upstanding arms, which are adapted to be positionally secured against the chassis, so as to position the chuck essentially orthoginal to the chassis;

(iii) means for adjustably positioning and securing the U-shaped chuck relative to the chassis such that a change in the relative position between the chuck and chassis accommodates various cross-sections of longitudinal members which extend through that region defined by the chuck and chassis;

(iv) means for securing the vibrator onto the chassis; and (v) means for holding and placing the vibrating tool against the anvil;

(e) a plurality of cables, each having one end connected to one of the supporting connectors, said cables meeting at a central connector remote from said supporting connectors and which is held by a hoist device, whereby holding and positioning the support frame into a position inclined to the vertical can be achieved;

(f) means for activating the vibrator so that the vibrating tool vibrates the longitudinal member into migrational penetration into the soil;

(g) said longitudinal member being a pipe and having a cable attached to one end thereof and extending the length of the pipe to the other end;

(h) a disc having an outside diameter approximately as large as the inside diameter of said pipe, connector means on the disc adapted to be attached to the end of the cable, means for severing the cable from the pipe and for attaching the severed cable to the disc connector means, and means for pulling the cable and hence the disc through the pipe, whereby any containments in the pipe may be substantially removed.

The invention will now be described by way of example and reference to the accompanying drawings in which.

Figures 1, 3:
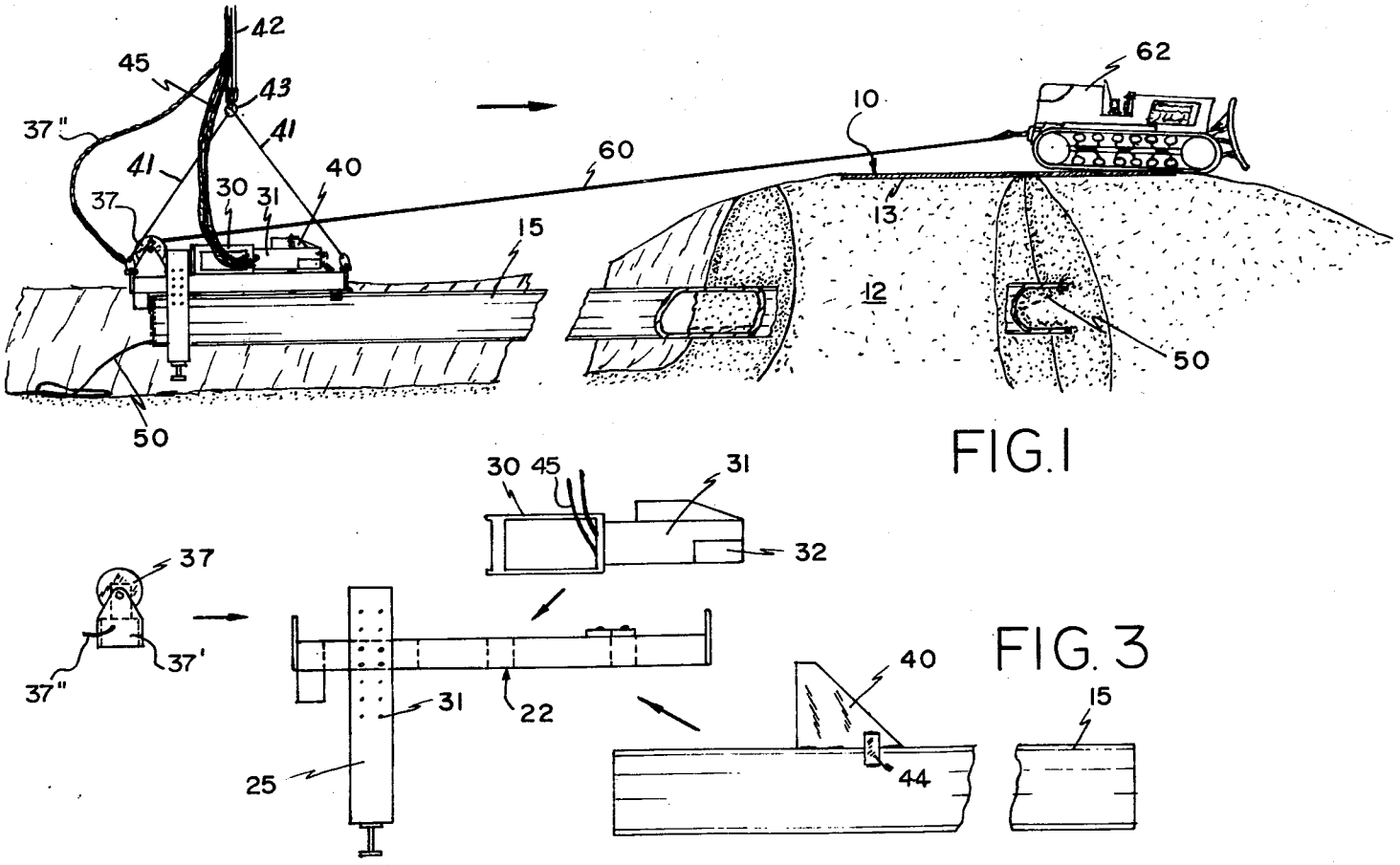
FIG. 1 is a perspective of the embodiment of the invention during initial preparation of a cassion or pipe for lateral insertion under a roadway.

FIG. 3, located with FIG. 1, is an assembly of FIG. 3.

Figure 4:
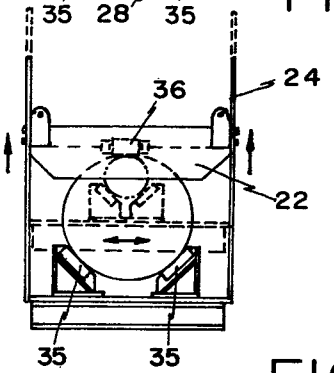

FIG. 4 is an end view showing means by which the frame may accommodate various sizes of pipe.

Figure 5:
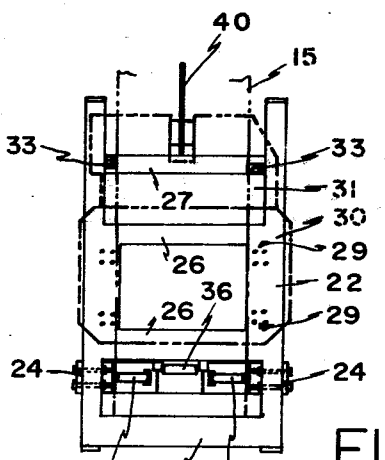

FIG. 5 is a plan view of the frame, the vibrator shown in phantom.

Figure 6:
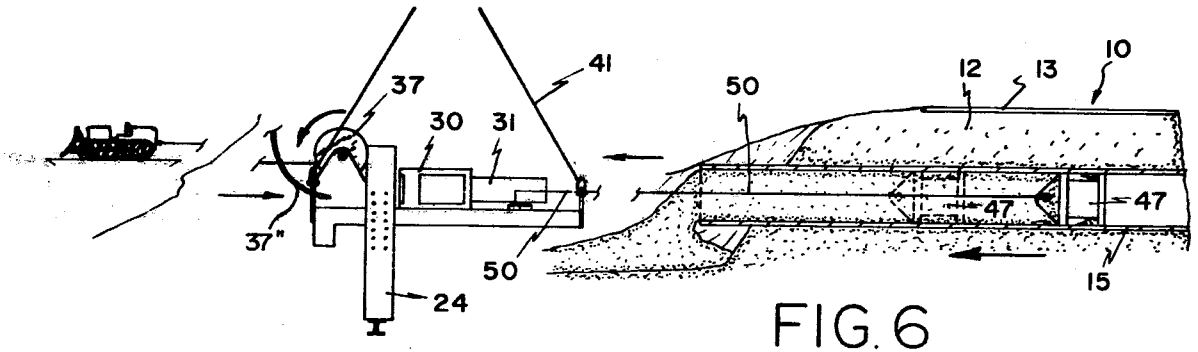
Figure 2:
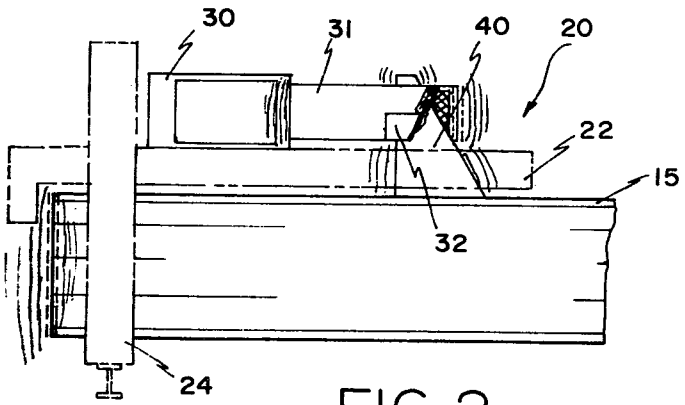
FIG. 2 is a view in elevation of the support frame used to hold the pipe.

FIG. 6 is the perspective of FIG. 1 after the pipe has been placed into position under the roadway and during the pipe core removal operation.

Figure 7:
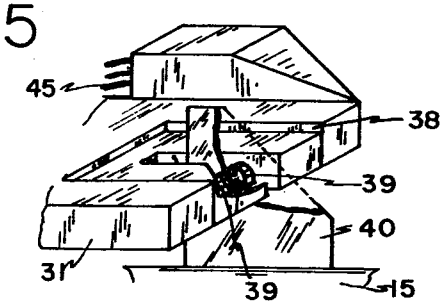

FIG. 7 is a perspective partially in section of the driving head.

Referring now to FIG. 1, a roadway 10 includes an elevated roadbed 12 with a running surface 13. A pipe 15 which is to be located under the running surface and to extend beyond the lateral margins of the roadway can typically be a gas or oil pipe, or a sewer pipe or the like.

A frame structure 20 consists of a generally flat horizontal chassis 22 and a U-shaped vertical chuck 24 with upstanding arms 25 adjustably positioned relative to the chassis. The upper surface of the chassis is arranged with central lateral cross members 26 a fore cross member 27 and a rear cross member 28.

Over the central cross members into sets of apertures 29 is bolted a vibrating tool 30 so that it rests with its vibrating member 31 extending away from the chuck toward the fore of the frame.

The arms 25 of the chuck have a plurality of apertures 31 therein and the outside margins of the frame 22 are provided with corresponding apertures. Bolts 33 extend through a pair of apertures in each arm and corresponding apertures in the frame positionally securing the chuck relative to the frame to thereby accommodate various sizes of pipe. The base of the chuck is provided with a pair of inclined rollers 35, which may be positionally located there along while the frame carries an upper centrally positioned fixed roller 36. The inclined rollers 35 are positionally secured at various relative distances so as to accommodate the different sizes of pipe. They are held in position by appropriate nuts and bolts (not shown). Thus by the relative location of the inclined rollers 35 and the chuck position relative to the chassis the frame can accommodate different pipe sizes (see FIG. 4) so that the circumference of thepipe runs along the rollers 35 and 36. A cable winch 37 is mounted at the rear of the upper surface of the frame, and the winch is powered by a hydraulic motor 37', which communicates, via hydraulic conduits 37" to a hydraulic pump (not shown). This winch applies a constant lateral force to the pipe, as will be later described, so as to ensure lateral migration of the pipe during vibraion. The frame 22 has 4 corner mounts 39 to which are affixed support cables 41 which rise and meet at a central connector 43 and connect to a hoisting cable 42 (see FIG. 1) of a crane (not shown). Thus the support frame and vibrator tool may be moved by the crane into any desired position, whether horizontal or inclined.

To complete the assembly, for use, an anvil flange 40 is welded to the pipe 15. For additional strength, support blocks 44 may also be welded to each side interface of the flange 40 and pipe 15. The vibrating member 31 is provided with a recessed clamping assembly 38. The clamping assembly is provided with diametrically opposed hydraulically operated ram members 39 which occupy the recess 38. When the flange 40 is inserted into the recess 38 the ram members 39 engage the flange between them. Thus a secure anvil flange vibrator interface is established as the driving head of the vibrator.

Prior to the pipe 15 being placed at the region of penetration, a cable 50 (core clean-out cable) is welded to the penetrating end of the pipe and extends through the pipe to play out slack at the other end. As will be explained later this cable will be used to clean out the pipe of soil (remove the core) after the pipe is insitu beneath the roadway.

The vibrator tool 30 is mounted and bolted onto the frame 22 with the vibrating member 31 encompassing the anvil 40. The ram members 39 engage the flange 40. Actually the vibrating member rests on laterally disposed support rollers 33. These relieve any vertical stress on the vibrating member 31 and assume alignment with the flange 40. The tool 30 is bolted into place. Hydraulic cables 45 connect, on the one hand, to the vibrator tool 30, to drive the vibrating member 31 into vibration, and as well to drive the ram members 39 into positive engagement with the anvil flange 40; they connect on the other hand to a suitable pump (not shown). The winch hydraulic cables 37" also attach to the same pump. The winch 37 has the free end of its cable 60 attached to a stationary body for example that of a stationary tractor 26. The vibrator is powered by the pump which drives the internal components thereof into eccentric movement. This eccentric movement causes vibration in the vibrating member 31 and this is transmitted through the driving head and the anvil 40 to the pipe 15. The pipe 15.vibrates. The winch 37 is slowly wound down by which a constant force is applied to the vibrating pipe tip; the pipe begins penetrating the soil beneath the roadbed. Eventually it is driven to extend through to the other side of the roadbed. The pipe positioning is now complete. The winch is stopped and the vibration is terminated. The hydraulic ram members are released from the flange 40. The penetration of the pipe into the soil leaves a core of soil in the pipe, thus the pipe is clogged. The pull cable 50 is then severed from the penetrating end of the pipe 15 and a clean-out disc 47 affexed to that end of the cable by suitable means. The outside diameter of the clean-out disc 47 fits through the inside diameter of the pipe 15. The winch cable 60 is disconnected from the tractor and is then played out to be reattached to a relocated position of the tractor 26, as shown in FIG. 6, or another stationary object. The slack end of the cable 50 is placed between the ram members 39 and the members activated to hold the slack end of the cable. The winch is activated again and this pulls the frame away from the pipe while at the same time the clean-out disc 47 is pulled through the pipe 15 removing the core. The flange 40 is then cut off the pipe. The pipe is now ready for its intended use.

The embodiments of the invention in which an exclusive property or privilege as claimed is defined as follows:

1. The method of inserting and embedding a pipe essentially laterally into and through soil without removing the overburden comprising the steps of:

(a) affixing to one end of the pipe, which is to penetrate the soil, a cable and extending the cable through the pipe to extend out the other end;

(b) engaging the penetrating end of the pipe with the soil;

(c) vibrating the pipe until the pipe is migrated into the soil a predetermined distance and the penetrating end of the pipe has passed completely through the overburden;

(d) severing the cable from the end of the pipe and affixing a clean out disc with a diameter essentially coincident with the inside diameter of the pipe to the end of the cable;

(e) withdrawing the cable from the pipe by pulling the disc from the penetrating end through the pipe to the other end by which any soil residing as core in the pipe is substantially removed.

2. An apparatus for penetrating a longitudinal member laterally into and through soil without removal of the overburden comprising:

(a) a longitudinal member;

(b) a vibrator having a vibrating tool;

(c) an anvil means attached to the longitudinal member and engageable by the vibrating tool to impart longitudinal vibrations to said longitudinal member;

(d) a support frame for cooperatively holding the vibrator and the longitudinal member in a non-vertical position, the support frame including:

(i) a generally flat chassis having supporting connectors affixed thereto;

(ii) a U-shaped chuck with upstanding arms, which are adapted to be positionally secured against the chassis, so as to position the chuck essentially orthoginal to the chassis;

(iii) means for adjustably positioning and securing the U-shaped chuck relative to the chassis such that a change in the relative position between the chuck and chassis accommodates various cross-sections of longitudinal members which extend through that region defined by the chuck and chassis;

(iv) means for securing the vibrator onto the chassis; and (v) means for holding and placing the vibrating tool against the anvil;

(e) a plurality of cables, each having one end connected to one of the supporting connectors, said cables meeting at a central connector remote from said supporting connectors and which is held by a hoist device, whereby holding and positioning the support frame into a position inclined to the vertical can be achieved;

(f) means for activating the vibrator so that the vibrating tool vibrates the longitudinal member into migrational penetration into the soil;

(g) said longitudinal member being a pipe and having a cable attached to one end thereof and extending the length of the pipe to the other end;

(h) a disc having an outside diameter approximately as large as the inside diameter of said pipe, connector means on the disc adapted to be attached to the end of the cable, means for severing the cable from the pipe and for attaching the severed cable to the disc connector means, and means for pulling the cable and hence the disc through the pipe, whereby any containments in the pipe may be substantially removed.

3. The apparatus as claimed in claim 2, wherein the pipe is cylindrical, the U-shaped chuck having inclined rollers relatively positioned thereon, the chassis having a roller thereon, whereby the positional location of the chuck and chassis cause the rollers to engage the cylindrical pipe and constrain it relative to the support frame.

* * * * *